US005947230A

United States Patent [19]

Ohta

[11] Patent Number: 5,947,230

[45] Date of Patent: Sep. 7, 1999

[54] LUBRICATING DEVICE FOR AN ENGINE

[75] Inventor: Katsuya Ohta, Shizuoka-ken, Japan

[73] Assignee: Suzuki Motor Corporation, Japan

[21] Appl. No.: 08/933,116

[22] Filed: Sep. 18, 1997

[30] Foreign Application Priority Data

Nov. 29, 1996 [JP] Japan ..... 8-334840

[51] Int. Cl.[6] ..... F01M 11/00

[52] U.S. Cl. ..... 184/7.4; 184/6.12; 123/196 CP

[58] Field of Search ..... 74/606 R; 184/6.12, 184/7.4, 7.3; 251/149.6, 63.6, 149.8; 123/90.33, 90.35, 90.38, 90.1, 196 CP, 196 R, 190.3, 188.2; 137/514, 540

[56] References Cited

U.S. PATENT DOCUMENTS

| | | | |
|---|---|---|---|
| 4,607,601 | 8/1986 | Kohler | 123/90.31 |
| 5,078,106 | 1/1992 | Matsuo et al. | 123/196 R |
| 5,249,556 | 10/1993 | Emmitt | 123/196 CP |
| 5,339,776 | 8/1994 | Regueiro | 123/196 CP |
| 5,752,546 | 5/1998 | Yamashita | 137/540 |
| 5,782,141 | 7/1998 | Schoolcraft | 74/606 R |
| 5,857,442 | 1/1999 | Sumi | 123/196 R |

FOREIGN PATENT DOCUMENTS 3-51156 5/1991 Japan .

*Primary Examiner*—Thomas R. Hannon
*Assistant Examiner*—David M. Fenstermacher
*Attorney, Agent, or Firm*—Morrison Law Firm

[57] ABSTRACT

A relief valve, anchored to a rotor plate, is centered in a concave housing area in a front journal bearing of an engine. Insetting the relief valve into the front of the engine correspondingly reduces the overall length of the engine. A semi-cylindrical auxiliary housing area is contiguous with the concave housing area. The auxiliary housing area and the concave housing area are spaced from the relief valve to provide a relief passageway for oil flow. The auxiliary housing area overhangs at least a portion of the relief valve. A relief hole in the relief valve leads to the relief passageway. Splashing of excess oil which is relieved from the relief valve is prevented, and smooth recovery of oil is enabled. Aeration is also lowered.

4 Claims, 4 Drawing Sheets

LUBRICATING DEVICE FOR AN ENGINE

BACKGROUND TO THE INVENTION

The present invention relates to a lubricating device for an engine. In particular, the present invention relates to a lubricating device for an engine in which a relief valve is anchored to a rotor plate.

An engine oil pump takes up and pressurizes oil from an oil pan. The pressurized oil is delivered in the area to be lubricated. An oil passageway receiving pressurized oil from the oil pump includes a relief valve which maintains the oil pressure in the oil passageway at a predetermined value.

In general, a relief valve is held in the closed position by a spring until the pressure in the relief passageway exceeds a setpoint. At higher oil pressures, the relief valve is opened to relieve the excess pressure.

An example of a lubricating device for an engine is disclosed in laid-open Japanese utility model publication number 3-51156. A crank case lower half frame of an engine making up the lower half of a crank case of an engine has a front wall, a middle wall box, and a back wall, all placed between right and left side walls. These side walls are constructed as a single body to form the crank case lower half frame. On the lower end of each of the front wall, wall box, and back wall, there is a reinforcement plate attachment surface. An oil retaining/reinforcement wall is placed against the reinforcement plate attachment surface and is fastened by fastening means in a manner that permits disassembly.

Referring to FIG. 5, an engine 102 of the prior art includes a lower case 106. A rotor plate 108 and a chain case 110 are disposed on the front side of engine 102. Rotor plate 108 is anchored to the back of chain case 110 by an anchoring bolt which is not shown.

Rotor plate 108 and chain case 110 are disposed on a first journal bearing 114 of lower case 106. The front side of front journal bearing 114 of lower case 106 is flat. A relief valve 116 is integrated into the front of front journal bearing 114 and one end (the right side in FIG. 5) of rotor plate 108. Relief valve 116 is anchored to the front of first journal bearing 114 slightly forward of front journal bearing 114. The forward placement of relief valve 116 avoids interference with front journal bearing 114.

The above arrangement provides a thickness of chain case 110 equal to L1. This arrangement increases the overall length of the engine. This is a disadvantage in practical applications.

Because thickness L1 of chain case 110 is large, the weight of chain case 110 is also large. As a consequence, engine 102 is heavier than desired.

Furthermore, excess oil relieved from relief valve 116 is relieved in front of front journal bearing 114 on lower case 103 which is formed flat. The excess oil tends to splash, thereby complicating smooth oil recovery. Splashing aerates the oil, which carries danger of reduced performance.

OBJECT AND SUMMARY OF THE INVENTION

It is an object of the invention to provide an engine design which overcomes the disadvantages of the prior art described above.

It is a further object of the present invention to provide a lubricating device for an engine, wherein: a lower case is attached to the lower part of a cylinder block of an engine which has a plurality of cylinders. A rotor plate and a chain case are placed serially on the front side of the engine. One part of the rotor plate and the chain case cooperate to function as an oil passageway communicating with an oil pump A relief valve is anchored on the rotor plate between a front journal bearing of the lower case and the rotor plate. A concave housing area on one part of the front journal bearing houses the relief valve at the time of attachment of the rotor plate. The concave shape of the housing area conforms to the shape of the relief valve.

Briefly stated, the present invention provides a relief valve, anchored to a rotor plate. The relief valve is centered in a concave housing area in a front journal bearing of an engine. Insetting the relief valve into the front of the engine correspondingly reduces the overall length of the engine. A semi-cylindrical auxiliary housing area is contiguous with the concave housing area. The auxiliary housing area and the concave housing area are spaced from the relief valve to provide a relief passageway for oil flow. The auxiliary housing area overhangs at least a portion of the relief valve. A relief hole in the relief valve leads to the relief passageway. Splashing of excess oil which is relieved from the relief valve is prevented, and smooth recovery of oil is enabled. Aeration is also lowered.

According to an embodiment of the invention, there is provided a lubricating device for an engine of a type having a lower case attached to the lower part of a cylinder block of the engine, comprising: a rotor plate and a chain case serially affixed on the engine, an oil passageway integrally formed by cooperating parts of the rotor plate and the chain case functions, the oil passageway being effective for communicating pressurized oil from an oil pump, a relief valve anchored on the rotor plate between a front journal bearing of the lower case and the rotor plate, a concave housing area on the front journal bearing, the concave housing containing the relief valve, and the concave housing area has a cross sectional shape which conforms to a shape of the relief valve.

According to a feature of the invention, there is provided a lubricating device for an engine, comprising: a rotor plate affixed to the engine, an oil pressure relief valve affixed to the rotor plate, a concave housing area in a forward part of the engine, the oil pressure relief valve being fitted into the concave housing area, the concave housing area being shaped to encircle a portion of the pressure relief valve, and the concave housing area being spaced from the oil pressure relief valve to form at least a portion of a relief passageway for the flow of oil therethrough.

According to a further feature of the invention, there is provided a lubricating device for an engine, comprising: a rotor plate affixed to the engine, an oil pressure relief valve affixed to the rotor plate, a concave housing area in a forward part of the engine, a partially spherical auxiliary housing area contiguous with the concave housing area, the oil pressure relief valve being fitted into the concave housing area, the concave housing area being shaped to encircle a portion of the pressure relief valve, and the auxiliary housing area overlapping at least a portion of the pressure release valve, the concave housing area and the auxiliary housing area being spaced from the oil pressure relief valve to form at least a portion of a relief passageway for the flow of oil therethrough, a relief hole in the relief valve, and the relief hole communicating between an interior of the relief valve and the relief passageway, whereby oil released by the relief valve is enabled to flow through the relief passageway.

The above, and other objects, features and advantages of the present invention will become apparent from the following description read in conjunction with the accompanying drawings in which like reference numerals designate the same elements.

DETAILED DESCRIPTION OF THE PREFERRED EMBODIMENT

In the present invention, the relief valve is housed in a concave housing area in one part of a front journal bearing of a lower case. This placement permits shortening the length of the engine and consequently reducing the weight of the lower case. Splashing of excess oil discharged from the relief valve is prevented. Smooth recovery of the oil is enabled with reduced oil aeration.

Figure 1:
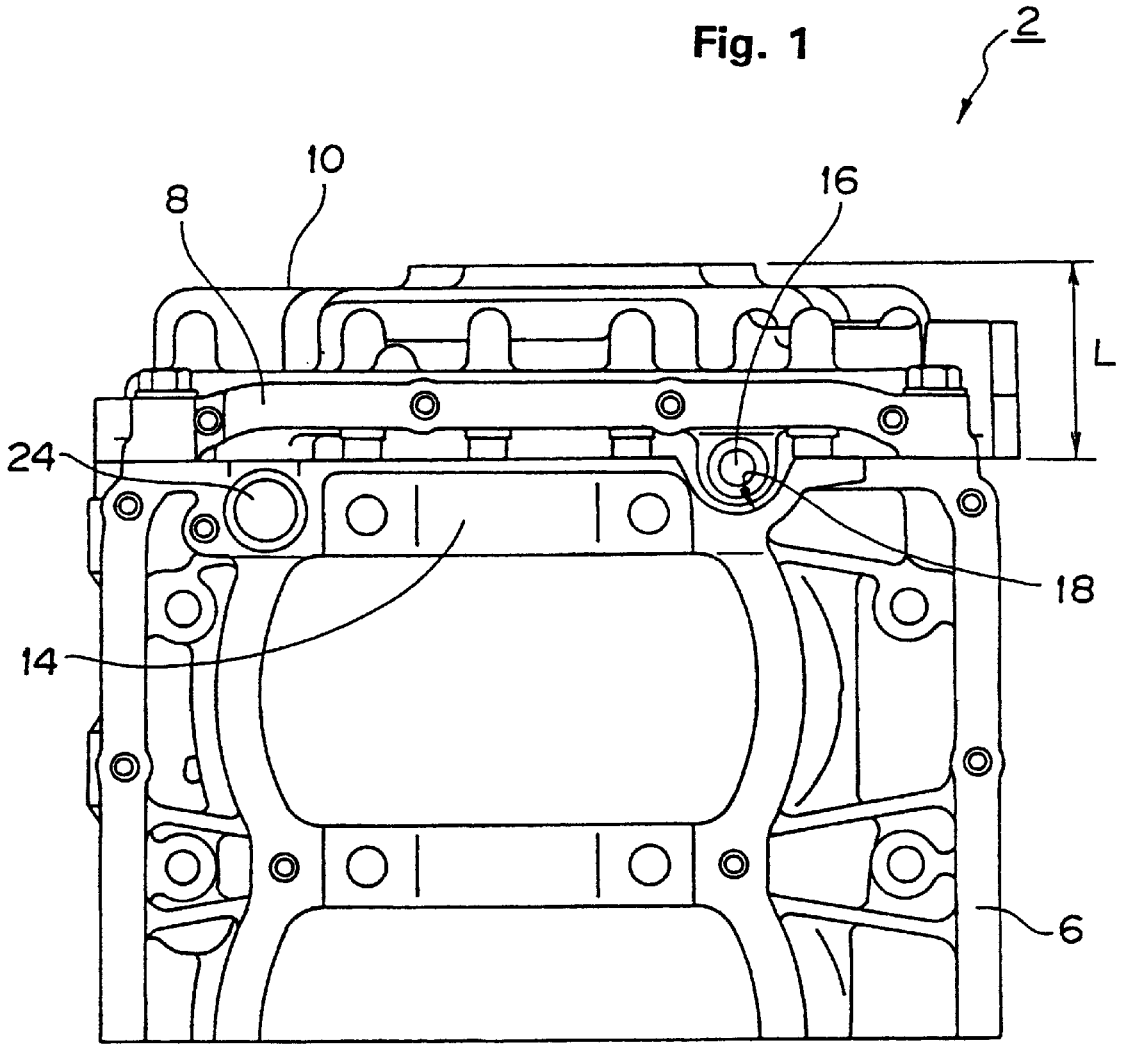
FIG. 1 is a plan view of a lower case of an engine which includes a lubricating device according to an embodiment of the present invention.
Figure 2:
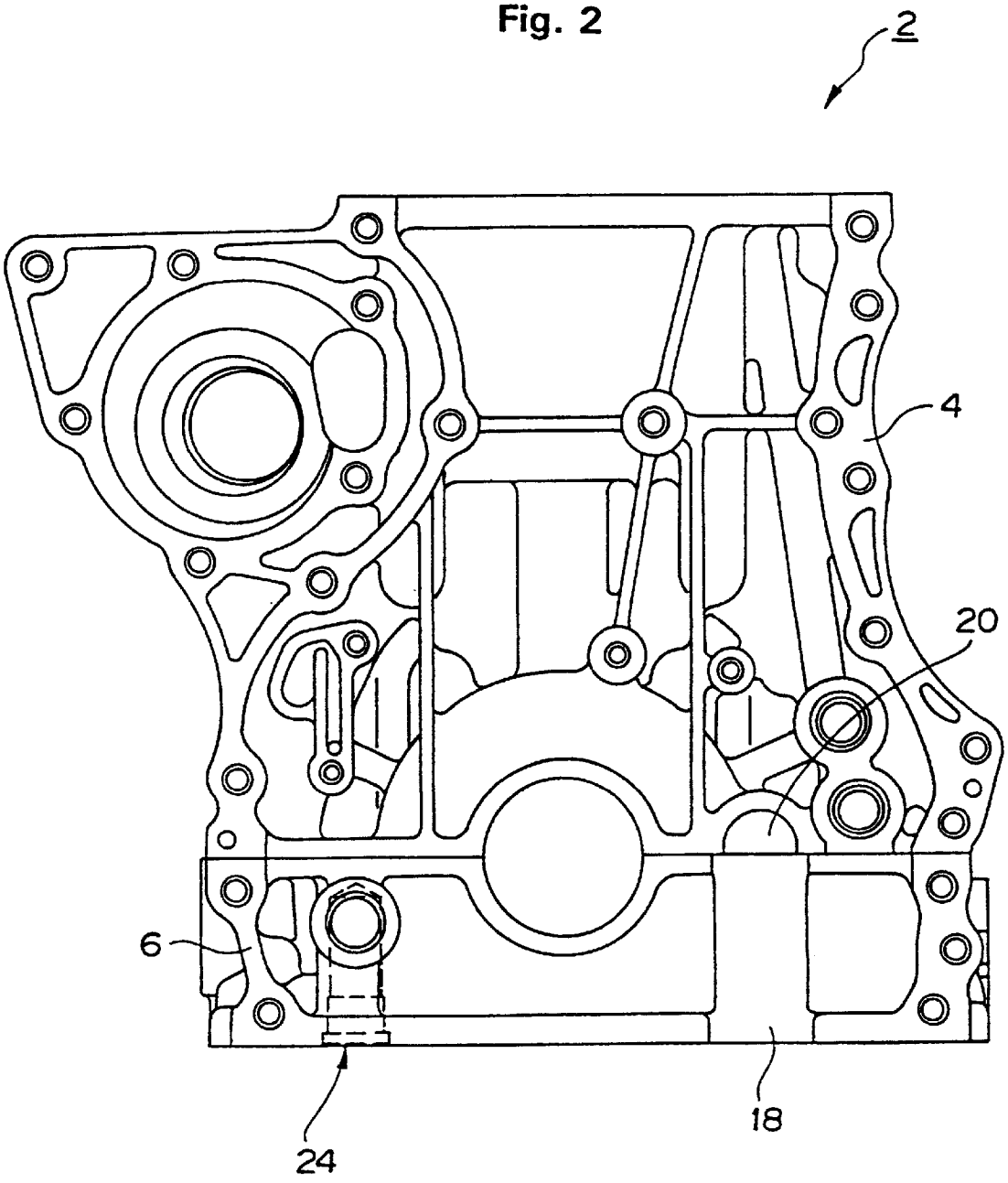
FIG. 2 is a front view of a cylinder block and a lower case including the lubricating device of the present invention.
Figure 3:
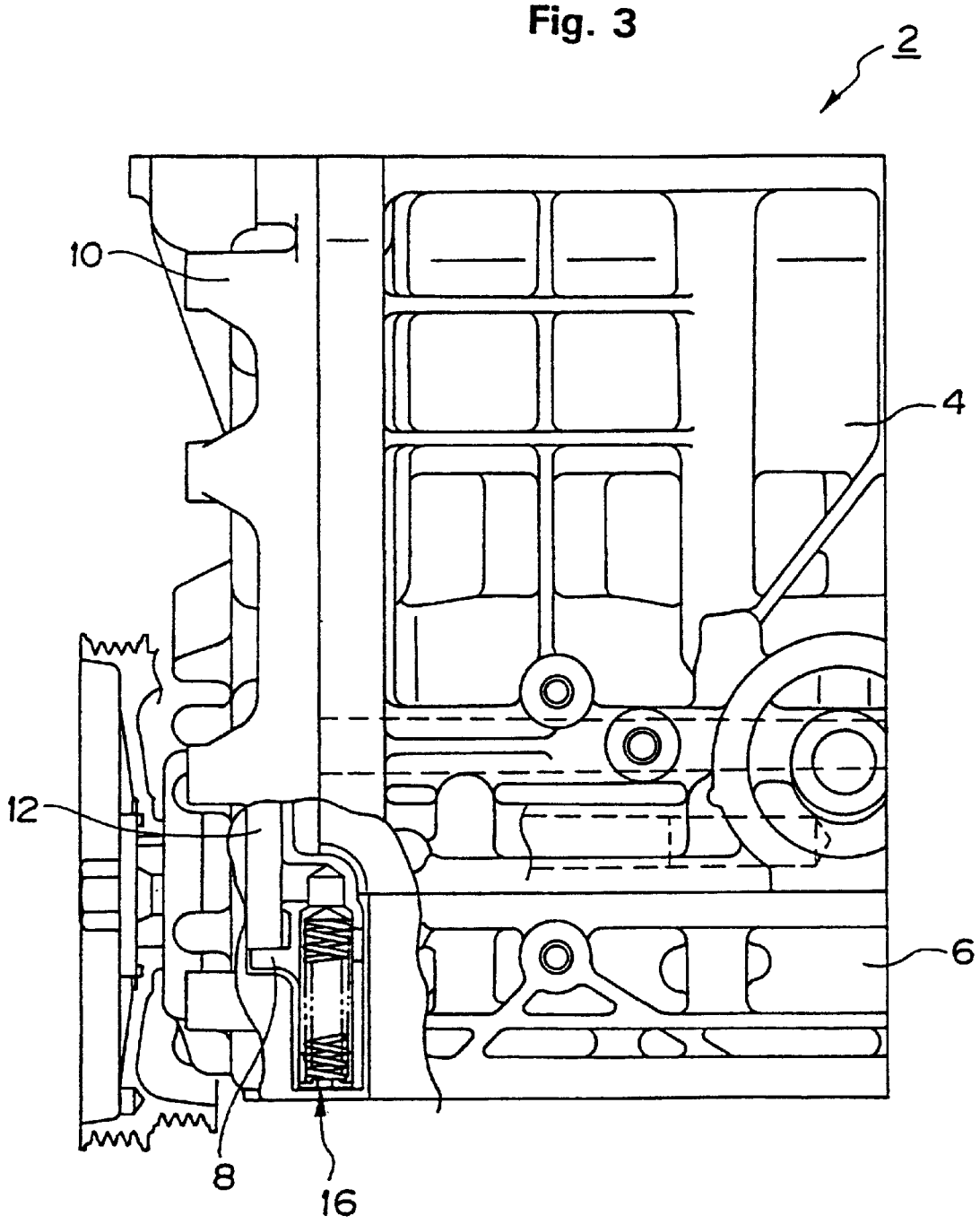
FIG. 3 is a right side view of a cylinder block and a lower case of FIG. 1 with a chain case attached showing the location of the lubricating device of FIG. 1.

Referring to FIGS. 1, 2 and 3, an engine 2, of a type having a plurality of cylinders, includes a cylinder block 4. A lower case 6 is attached to a lower part of cylinder block 4. A conventional oil pan (not shown) is attached below lower case 6, as is conventional. A rotor plate 8 is connected to the front of engine 2. A chain case 10 is affixed in front of rotor plate 8. A cylinder head (not shown) is attached to the upper part of cylinder block 4.

Rotor plate 8 and chain case 10 are placed serially in that order on the front of engine 2. An oil passageway 12 is formed by cooperating shapes integrally formed in rotor plate 8 and lower case 6. Oil passageway 12 communicates with an oil pump (not shown).

A relief valve 16 is anchored to rotor plate 8 between rotor plate 8 and a front journal bearing 14 which is formed on lower case 6.

With rotor plate 8 attached to lower case 6, relief valve 16 which is integrally formed in one end (the right side of FIG. 1) of rotor plate 8 is positioned between front journal bearing 14 of lower case 6 and rotor plate 8.

One part of front journal bearing 14 includes a concave housing area 18 into which relief valve 16 is fitted during installation of rotor plate 8. Concave housing area 18 generally conforms to the shape of relief valve 16.

Referring to FIG. 1, concave housing area 18 is located at one end (right side of FIG. 1) of front journal bearing 14 of lower case 6. Concave housing area 18 is a semicircular arc which conforms to the shape of relief valve 16.

Figure 4:
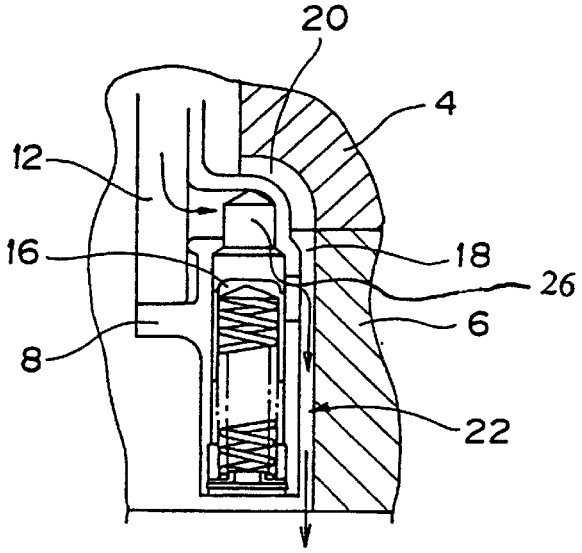
FIG. 4 is an enlarged schematic cross sectional drawing of the relief valve placement.
Figure 5:
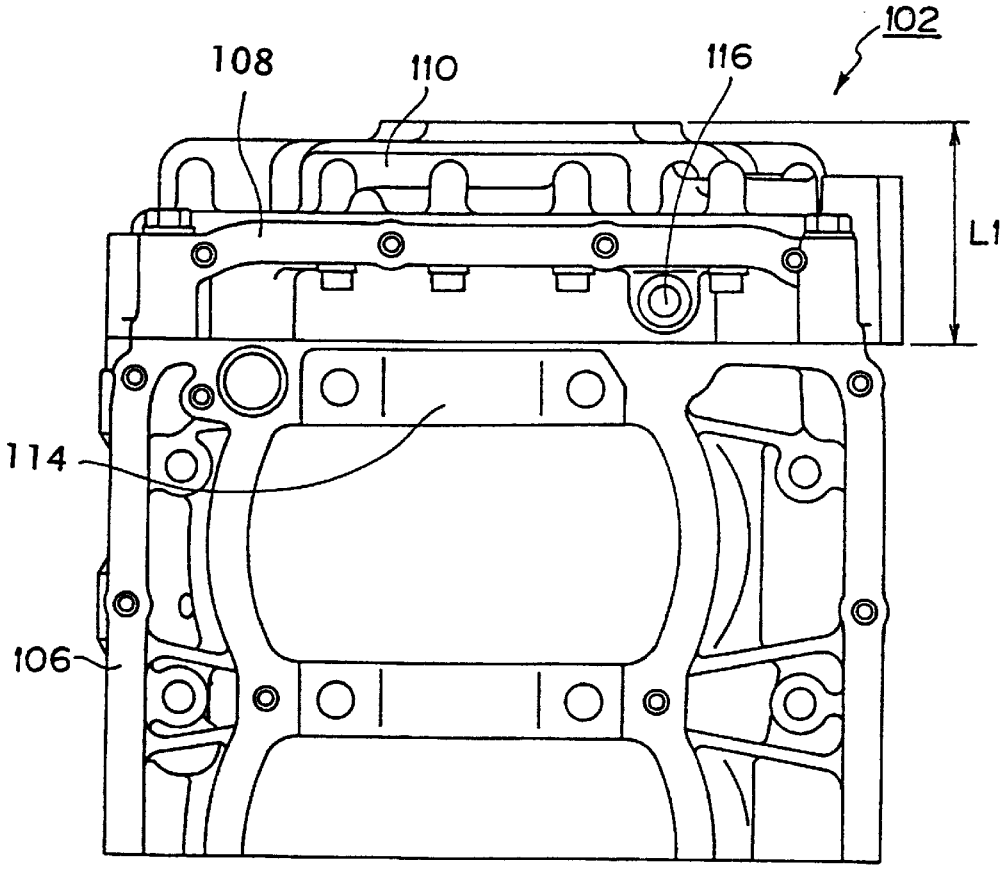
Fig. 5 PRIOR ART
FIG. 5 is a plan view of a lower case of a lubricating device for an engine of the prior art.

Referring to FIGS. 2–4, an auxiliary housing area 20 is formed at the upper end of concave housing area 18, or in other words, the lower end of cylinder block 4. Auxiliary housing area 20 fits over the upper end of relief valve 16. Auxiliary housing area 20 in the shape or ¼ sphere. This partially spherical cross section is represented in FIGS. 3 and 4 as an arc.

With relief valve 16 housed in concave housing area 18 and auxiliary concave housing area 20, an arc-shaped relief passageway 22 is formed in the space between relief valve 16, cylinder block 4, and lower case 6. Excess oil within oil passageway 12 is relieved through relief passageway 22.

Furthermore, on the outermost position of front journal bearing 14 of lower case 6, oil stainer in other words at the other end (on the left side of FIG. 1) of front journal bearing 14, there is an attachment hole 24 where an oil strainer (not shown) is attached.

A relief hole 26 is formed on relief valve 16 for directing oil flow into relief passageway 22 which exists as a result of concave housing area 18 and auxiliary housing area 20. Thickness L is the amount of projection from lower case 6 when rotor plate 8 and chain case 10 are serially placed on lower case 6. In other words, thickness L is the thickness of chain case 10.

Next, the operation is explained.

When rotor plate 8 is attached to the front side of lower case 6 of engine 2, relief valve 16 which is integrated and anchored to one end (right side of FIG. 1) of rotor plate 8 is housed in concave housing area 18 which is formed as a semi-circular arc on one end (right side of FIG. 1) of front journal bearing 14 of lower case 16. The upper part of relief valve 16 is housed in auxiliary housing area 20. Relief passageway 22 is created between concave housing area 18 and auxiliary housing area 20.

When engine 2 is running, excess oil pressure of the oil flowing in oil passageway 12 is relieved through relief hole 26 of relief valve 16. After passing through relief passageway 22, the oil is recovered in an oil pan (not shown).

As a result, at the time of rotor plate 8 installation, relief valve 16 is housed in concave housing area 18 located on front journal bearing 14 of lower case 6. Compared to the prior art, thickness L of chain case 10 is small, and the overall length of the engine is shortened. This is advantageous in practical applications.

Lower case 6 is lightened by the space used to form concave housing area 18. Chain case 10 is lightened by the amount that thickness L of chain case 10 is decreased. This contributes to the lightening of engine 2.

Furthermore, since relief valve 16 housed in concave housing area 18, splashing of excess oil relieved from relief valve 16, concave housing area 18 helps prevent splashing of oil. A smooth recovery of oil is enabled. Aeration is also reduced, and performance is improved.

In addition to forming concave housing area 18 on one end (right side of FIG. 1) of crank journal 14 of lower case 6, auxiliary housing area 20 is formed on the lower part of cylinder block 4. As a result, cylinder block 4 is also lightened by the amount of space created by auxiliary housing area 20. This contributes to the lightening of engine 2.

With relief valve 16 housed in concave housing area 18 and auxiliary concave housing area 20, an arc-shaped relief passageway 22 is created between relief valve 16 and cylinder block 4 and lower case 6. Splashing of excess oil relieved from relief hole 26 of relief valve 16 is prevented by relief passageway 22. Smooth oil recovery is obtained, and aeration is reduced.

Furthermore, by having attachment hole 24 for the oil strainer (not shown) on the outermost part of front journal bearing 14 of lower case 6, or in other words, the other end (left side of FIG. 1) of front journal bearing 14, the oil strainer can be placed on the outermost position of front journal bearing 14 by attachment hole 24. As a result, the installation characteristic of the oil strainer is improved, and this is advantageous in practical applications.

As described in detail above, the present invention is a lubricating device for an engine, wherein: a lower case is attached to the lower part of a cylinder block of an engine which has a plurality of cylinders. A rotor plate and a chain case are serially placed on the front side of the engine. One part of the rotor plate and the chain case functions as an oil passageway which communicates with an oil pump. A relief valve which is anchored on the rotor plate is placed between a front journal bearing of the lower case and the rotor plate. On one part of the front journal bearing, there is a concave housing area which houses the relief valve at the time of attachment of the rotor plate. The concave housing area conforms to the shape of the relief valve. Consequently, the relief valve can be housed by the concave housing area at the time of rotor plate installation. Compared to the prior art, the overall length of the engine is advantageously shortened. This is especially advantageous in practical applications. Furthermore, the lower case is lightened by the space formed by the concave housing area. This further contributes to the lightening of the engine. Furthermore, by having the concave housing area hold the relief valve, splashing of excess oil relieved from the relief valve is prevented, and smooth recovery of oil is obtained. Aeration is also reduced, and performance is improved.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A lubricating device in an engine, comprising:

a rotor plate affixed to said engine;

an oil pressure relief valve affixed to said rotor plate;

a partially concave auxiliary housing area contiguous with said concave housing area;

said auxiliary housing area forming, with said relief valve, a further portion of said relief passageway for flow of oil in said engine;

a concave housing area in a forward part of said engine;

said oil pressure relief valve being fitted into said concave housing area;

said concave housing area being shaped to encircle a portion of said pressure relief valve thereby blocking the flow of oil therethrough when said oil pressure relief valve is in a closed position; and said concave housing area being spaced from said oil pressure relief valve to form at least a portion of a relief passageway for the flow of oil therethrough when said oil pressure relief valve is in an open position.

2. A lubricating device according to claim 1, further comprising:

a relief hole in said relief valve; and said relief hole communicating between an interior of said relief valve and said relief passageway, whereby oil released by said relief valve is enabled to flow through said relief passageway.

3. A lubricating device in an engine described in claim 1, further comprising an oil strainer attachment hole in said lower case.

4. A lubricating device in an engine, comprising:

a rotor plate affixed to said engine;

an oil pressure relief valve affixed to said rotor plate;

a concave housing area in a forward part of said engine;

a partially spherical auxiliary housing area contiguous with said concave housing area;

said oil pressure relief valve being fitted into said concave housing area;

said concave housing area being shaped to encircle a portion of said pressure relief valve blocking flow of oil when said oil pressure relief valve is closed;

said auxiliary housing area overlapping at least a portion of said pressure relief valve;

said concave housing area and said auxiliary housing area being spaced from said oil pressure relief valve to form at least a portion of a relief passageway for the flow of oil therethrough when said oil pressure relief valve is in an open position;

a relief hole is said relief valve; and said relief hole communicating between an interior of said oil pressure relief valve and said relief passageway, whereby oil released by said oil pressure relief valve is enabled to flow through said relief passageway.

* * * * *